US008046901B2

(12) United States Patent
Bordignon et al.

(10) Patent No.: US 8,046,901 B2
(45) Date of Patent: Nov. 1, 2011

(54) COMPACT PLANT FOR CONTINUOUS PRODUCTION OF BARS AND/OR PROFILES

(75) Inventors: Giuseppe Bordignon, Bicinicco (IT); Andrea De Luca, Remanzacco (IT); Gianni Zomero, Pasian di Prato (IT); Ivan Paiaro, Ronchi Dei Legionari (IT); Dario Lestani, Bicinicco (IT); Alfredo Poloni, Fogliano Redipuglia (IT)

(73) Assignee: Danieli & C. Officine Meccanicite S.p.A., Buttrio (IT)

( * ) Notice: Subject to any disclaimer, the term of this patent is extended or adjusted under 35 U.S.C. 154(b) by 1064 days.

(21) Appl. No.: 11/885,423

(22) PCT Filed: Mar. 1, 2006

(86) PCT No.: PCT/EP2006/060353
§ 371 (c)(1),
(2), (4) Date: Aug. 29, 2007

(87) PCT Pub. No.: WO2006/092404
PCT Pub. Date: Sep. 8, 2006

(65) Prior Publication Data

US 2008/0196236 A1 Aug. 21, 2008

(30) Foreign Application Priority Data

Mar. 2, 2005 (IT) ..... M12005A0315

(51) Int. Cl.
*B23P 13/04* (2006.01)
*B21B 27/06* (2006.01)

(52) U.S. Cl. ..... 29/527.6; 72/201

(58) Field of Classification Search ..... 29/527.6, 29/527.7, 64, 527.5, 34 R; 72/203, 201
See application file for complete search history.

(56) References Cited

U.S. PATENT DOCUMENTS

| | | | |
|---|---|---|---|
| 4,054,047 | A | 10/1977 | Sclippa |
| 4,307,594 | A | 12/1981 | Steinbock |

FOREIGN PATENT DOCUMENTS

| | | | |
|---|---|---|---|
| EP | 0 411688 | A1 | 2/1991 |
| EP | 1 187 686 | B1 | 7/2003 |
| IT | 1214159 | | 1/1990 |
| JP | 61147914 | | 7/1986 |
| WO | WO 02/070156 | A1 | 9/2002 |

OTHER PUBLICATIONS

Franco Alzetta; "New Endless Casting Rolling Plant for Specialty Steels at ABS"; Dec. 14, 2001; pp. 105-114.

(Continued)

*Primary Examiner* — John C Hong
(74) *Attorney, Agent, or Firm* — Stetina Brunda Garred & Brucker

(57) ABSTRACT

Compact plant for making steel bars and profiles with which, starting from the scrap, it is possible to obtain the finished product, for example bars with commercial length from 6 to 18 meters, pre-packed, packaged and ready for sale, with all the stations placed in line and operating continuously. All the stations are arranged in reduced spaces, thereby reducing both investment costs and plant management costs, and decreasing production times. Advantageously, the plant of the invention incorporates an extremely compact bar packaging apparatus which, through an innovative arrangement and innovative operating method of the components thereof, allows a further reduction in length.

20 Claims, 9 Drawing Sheets

OTHER PUBLICATIONS

M. Lestani; "New Concepts in the Production of Speciality Steels in Bars and Coils"; Oct. 1997; pp. 1225-1236.

Steel Times International; pp. 8 & 9.

Steel Times; "An Italian Supplier Consolidates a Growing Niche"; Nov. 1990; pp. 626-627.

Danieli; "Cooling Beds"; 2 pages.

COMPACT PLANT FOR CONTINUOUS PRODUCTION OF BARS AND/OR PROFILES

FIELD OF THE INVENTION

The present invention relates to a plant for producing bars and/or profiles, in particular a compact plant for continuous production of steel bars and profiles.

STATE OF THE ART

Numerous production plants for steel bars or profiles have stations that are not arranged in line and also have points in which the production line is interrupted. This causes limits to the efficiency and productivity of the plant, linked to the fact that the continuous casting machine and the rolling mill operate in a partially disconnected manner, with the need for an intermediate buffer to deal with the different operating requirements of these components.

Various continuous production plants for steel bars are known, such as the one described in the European patent EP1187686. Nonetheless, these production plants, which start directly from the scrap to obtain the finished product, already packed and packaged for sale, require considerable space leading to the use of large sheds, high investment and running costs.

These plants are provided with a packaging apparatus, positioned downstream of the rolling mill, which have the other disadvantage of not allowing high bar packaging speed and of not handling a diversified variety of rolled products; moreover, they are not compact, which also makes them costly to build and run. Finally, these types of packaging apparatus do not allow the production and handling of short bars, for example 6 m-long bars, which require much shorter, more precise and repetitive cycle times for cutting, braking and unloading.

Therefore, the need is felt for a compact plant for continuous production of rolled products, of any shape and size, composed of a plurality of dedicated apparatus which allows the aforesaid drawbacks to be overcome and is versatile in the type of bars and/or profiles to be handled.

SUMMARY OF THE INVENTION

The main object of the present invention is to produce a compact plant for producing steel bars and/or profiles by means of which, starting from scrap, it is possible to obtain the finished product, for example round, square, hexagonal, flat bars and or L-shaped, T-shaped, T-post, U-shaped profiles, of commercial lengths ranging from 6 to 18 meters, pre-packed, packaged and ready for sale, with all the stations in line and operating continuously.

Another object is to arrange all the machinery in smaller spaces, thereby reducing both investment costs and plant management costs, and to reduce production times.

A further object is to produce a flexible plant which makes it possible to obtain both medium-low productivity, for example ranging from 35 to 50 t/h, and medium-high productivity, for example from 50 up to 100 t/h.

Therefore, according to the present invention the objects discussed above are attained by means of a compact plant for continuous production of steel bars and/or profiles wherein, in accordance with claim 1, there is provided:

a steel plant station,
a casting station,
an extracting station
a rolling station characterized in that a compact finishing station is provided at the exit of the last rolling stand, suitable to cut hot and at rolling speed, bars and profiles of commercial length, and suitable to package said bars and/or profiles in packs or bundles of a defined weight ready for sale, and in that said stations are all in line without intermediate points of interruption.

The plant forming the object of the present invention is particularly compact as the arrangement of the various components is in line with no interruptions. Advantageously, this plant has a very compact bar or profile packaging apparatus which, through an innovative arrangement and innovative operating mode of the components thereof, makes it possible to obtain a further reduction in length.

Moreover, the plant of the invention is very versatile as it allows continuous production, handling and packaging of bars and/or profiles with different sections, always maintaining maximum production speed even with products with a small section, in particular thanks to the packaging apparatus. In fact, in the case of types of rolled products with a small section, which consequently reach the phase downstream of rolling, before packaging, at high speed, this plant makes continuous packaging possible without the need for long stocking times in large storage spaces.

Advantageously the plant of the invention has a number of components arranged in order to manage, in a shorter time, a larger number of types of rolled products of commercial sizes i.e. easier to manage in terms of storage and transport. The dependent claims describe preferred embodiments of the invention.

BRIEF DESCRIPTION OF THE FIGURES

Further characteristics and advantages of the invention shall be more evident in the light of the detailed description of a non-exclusive preferred embodiment, of a plant for the production of bars and profiles illustrated, by way of a non-limiting example, with the aid of the accompanying drawings, wherein.

DETAILED DESCRIPTION OF A PREFERRED EMBODIMENT OF THE INVENTION

Figure 1:
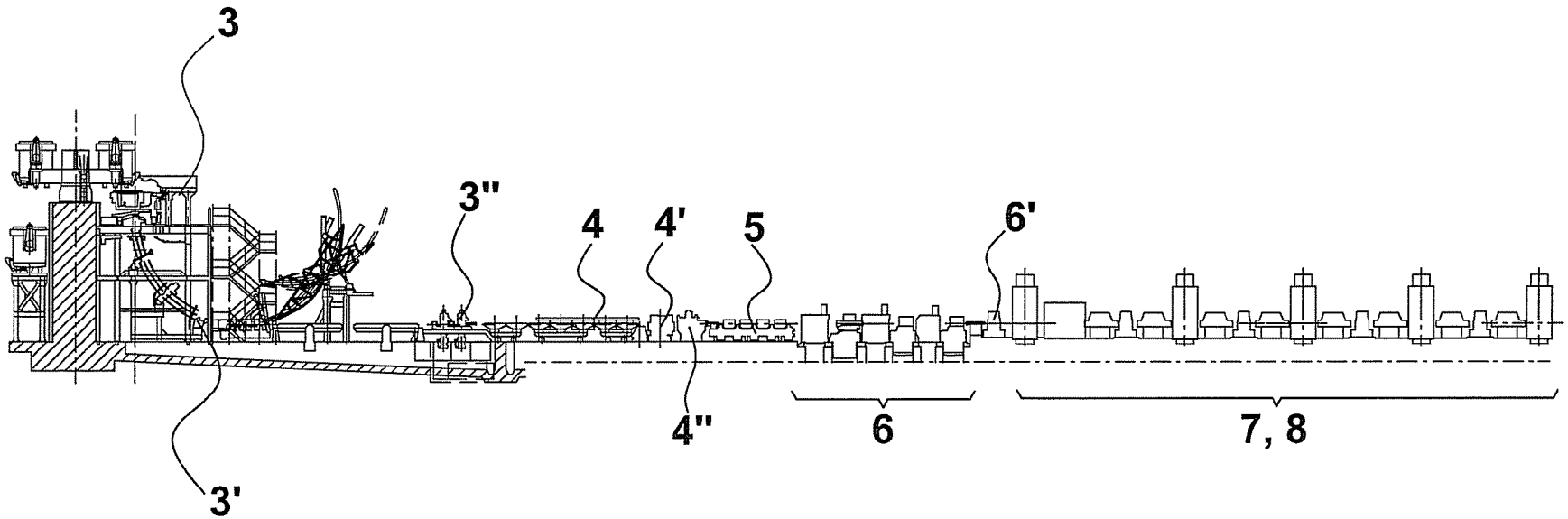
FIG. 1 shows a lateral view of part of the plant of the invention.

The plant for producing bars and profiles of the invention incorporates:

a steel plant station, from the scrap yard to the liquid steel;
a continuous casting station;
a cast product extracting station;
a continuous rolling station;
a continuous finishing station.

In the case of producing steel bars and profiles with a low/medium carbon content, downstream of the rolling station, a further cooling station is provided, comprising a series of water tanks containing water, or another coolant, to perform surface hardening of the product. This cooling station can, optionally, also be used for the production of microalloyed steels although only to perform cooling and not heat treatment of the rolled product.

The steel plant station incorporates a primary electric arc furnace and a secondary furnace or ladle furnace, or simply a ladle, to perform secondary metallurgy. The scrap is loaded into the electric arc furnace and subsequently, when molten, it is spilled into the ladle furnace where it is subjected to secondary treatment to obtain the desired composition of steel and reach a suitable temperature for subsequent pouring into the ingot mould. Owing to the characteristics of the product obtained with these secondary metallurgy operations, it is advantageous to subject said product to a continuous rolling process.

The casting station 3 incorporates a continuous one-line casting machine, a straightening machine 3' downstream and a shear 3" for cutting to length of the billet for operation in semi-continuous and continuous mode. Semi-continuous mode is temporary and is used to start the continuous process and to calibrate the rolling mill. The casting line is designed for high speed casting, for example up to 8 m/min, of square billets with a section of 110×110 $mm^2$ or equivalent sections.

In semi-continuous operating mode casting and rolling are two separate operations; in continuous operating mode rolling is the main operation, i.e. "master", and casting is a dependent operation, i.e. "slave", in the sense that the casting parameters depend on the rolling speed. The subsequent extraction station 4 incorporates a collecting table for withdrawing the billets in the event of an emergency, such as a hold-up downstream.

Advantageously, installed in line downstream of the extraction station 4 is a reheating furnace, preferably an induction furnace 5, defining a station of adequate length to control and regulate the temperature of the billets before they enter the rolling mill. If the steels produced are microalloyed or low carbon steels, it is not necessary to provide very long holding furnaces for metallurgical transformation of the grain, with a simple inductor, for example, being sufficient, thereby making further compacting of the production line possible.

Between the extraction station 4 and the induction furnace 5 there are provided a descaler 4' and a pinch-roll 4".

The rolling mill, defining a further station, is advantageously composed of:

a roughing mill/blank 6 with horizontal and vertical stands;
an intermediate mill 7 with horizontal and vertical stands;
a finishing mill 8.

In the lateral view of FIG. 1, between the roughing mill/blank 6 and the intermediate and finishing mills 7, 8 there is provided a flying shear 6'.

Advantageously, loop forming devices are not used between the stands in the roughing mill 6, but pull on the rolled product is controlled with further reduction in the overall dimensions.

Pull is controlled by checking the dimensional tolerances of the bar, measured by sensor means, and managing the rolling stands with forecasts and speed cascade. The sensor means calculate the real section of the material delivered from each stand and check the extent of deviation from the nominal value read in standard conditions without pull and transmit the results to the other stands, appropriately modifying the speed ratios therebetween.

Advantageously, although not necessarily, all the rolling stands have cantilever mounted rolling cylinders.

A first example of the system of the invention has eighteen rolling stands, four of which in the roughing mill, six stands in the intermediate mill and eight stands in the finishing mill, said finishing mill being advantageously composed of a high speed rolling station when bars with a small section are produced, for example at a rolling speed of about 40 m/s.

A second example of the plant of the invention is provided with sixteen rolling stands, eight of which in a roughing/intermediate mill and eight stands in the finishing mill.

A third example of the plant of the invention is provided with eighteen rolling stands, six of which in the roughing mill, six stands in the intermediate mill and six stands in the finishing mill.

The finishing mill in the second and third example is not composed of a high speed rolling station but of cartridge stands with rolling cylinders with several channels; the existence of physical spaces between these cartridge stands makes the solution of the first example the one offering the most compact plant.

Means for head-tail cropping and for scrapping of the rolled product in the event of an emergency are provided between the rolling mills. More specifically, in the configuration provided in said first and third example, two shears are installed, one between the roughing mill and the intermediate mill and one between the intermediate mill and the finishing mill, while in the second example a single shear is provided between the roughing/intermediate mill and the finishing mill.

In accordance with a first embodiment of the invention, shown in FIGS. 2 to 5, the plant is arranged to produce bars or profiles with a small section, for example, having a maximum cross dimension of up to 25 mm, and the finishing station incorporates an innovative integrated cutting, braking and bar packaging apparatus, or simply packaging apparatus, indicated globally with numeral 9.

This bar packaging apparatus 9 is in turn composed of:

a shear 10, with integrated deflector, for cutting to commercial length the bars delivered from the last rolling stand, at a temperature of between 600 and 900° C.;
two deflectors 11 and 12 suitable to deflect the bars cut into segments of commercial length towards four unloading lines;
a four-way braking unit, comprising four speed variation devices 13 of the bar segments, simply called bar-brakes;
two units with double rotating drum 14, forming four rotating drum units;
a bar segment collection and removal device.

The shear 10 advantageously, although not necessarily, cuts the bars delivered at high speed from the finishing mill into segments of variable predetermined lengths, for example from 6 to 18 meters. These bar segments thus obtained are directed through the integrated deflector along two lines exiting from the same shear 10. Installed downstream of the shear 10 are two deflectors 11, 12, each on one of said two lines, which direct the segments into the four unloading lines.

The braking devices, simply called bar-brakes 13, are installed at the entry to each of the four unloading lines. Each bar-brake receives the tip of a bar segment by means of rollers in the open position and rotating at a specific speed. At a predetermined instant, which allows braking to be performed in the correct space and time, the rollers close on the segment and perform the braking action, exploiting the dynamic roll-segment friction. At the exit from the bar-brake, these segments are then fed to an unloading system comprising axial peripheral guides or channels on rotating cylindrical drums. Control means calculate the release speed of the bar segment, at the end of the braking action of the bar-brake, on the basis of the position to be taken by the segment in one of said guides and on the basis of the bar-guide coefficient of friction. This release speed is lower than the delivery speed of the segment for products with small sections and could be higher than the delivery feed of the segment for products with larger sections. In this particular case, the bar-brake acts as an accelerator of the bar segments.

At a specific time after braking has terminated, the rollers of the bar-brake 13 are opened to receive the subsequent segment and accelerate or decelerate in order to adapt their peripheral speed to the new value calculated to unload the subsequent segment which, in fact, may be different to the speed of the previously unloaded segment.

The segments, cut to commercial length and braked as described above, are then fed into the axial peripheral guides of the rotating drums. These drums are of a length at least twice the length of the segments and their peripheral guides or channels are divided into two sections, initial and final, of a length equal to at least the length of the segment. For example, in the case of segments 6 m in length, the length of the initial and final sections of the guides is respectively 6 m plus a safety space. Therefore, the length of the drum is at least 12 m plus the safety space.

A device for collection and removal of the bar segments unloaded from the drums is located under said drums. Advantageously, a forced air cooling system cooperates with said device, composed of a cooling fan assembly, or a nebulized water cooling system with spray nozzles.

Figure 2:
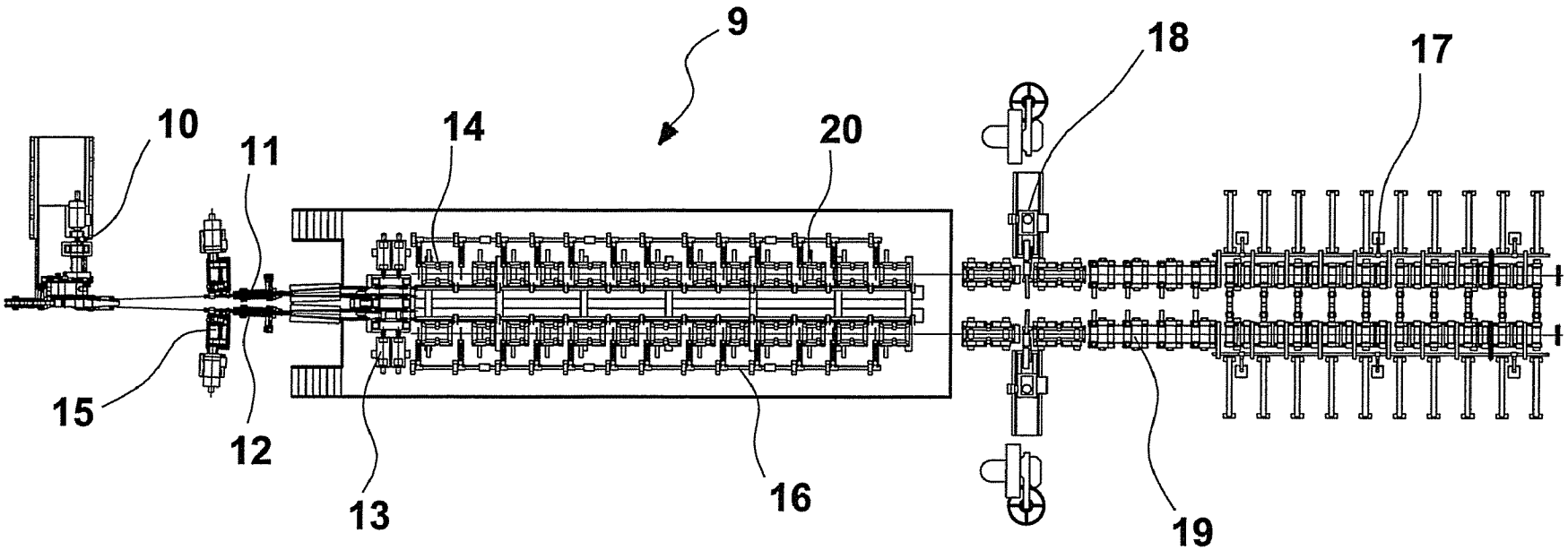
FIG. 2 shows a plan view of a first embodiment of part of the plant of the invention.
Figure 3:
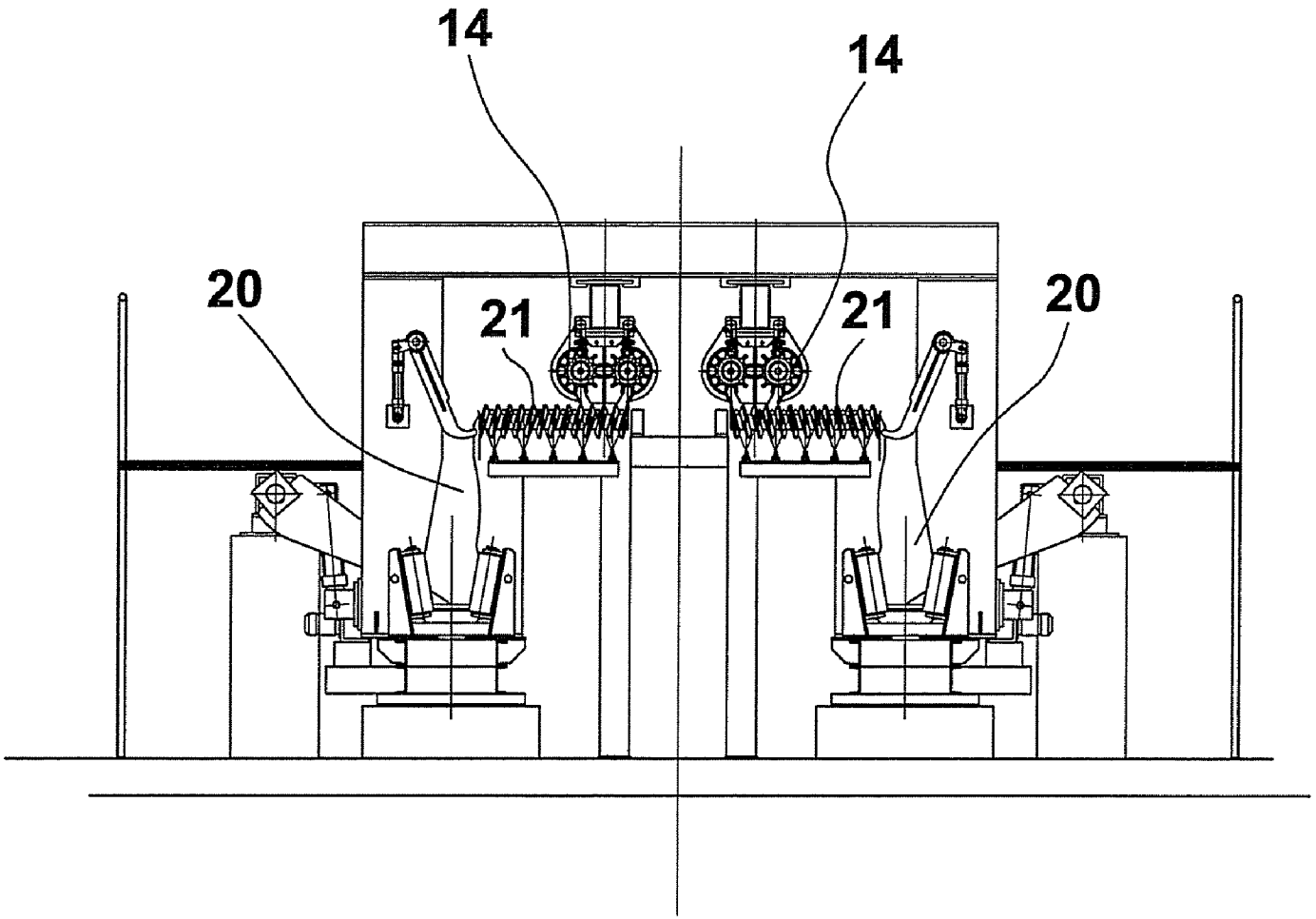
FIG. 3 shows a front view of the embodiment of FIG. 2.

In accordance with a first embodiment thereof, shown in FIGS. 2 and 3, the collection and removal device is preferably composed of a screw or group of worm screws 21 which are capable of translating the bar segments, essentially orthogonally or in any case with a component of motion transverse to the axis thereof, to one or more collection pockets 20, composed, for example, of idle vertical containment rolls and a horizontal roller table. Said screws can be operated separately and are positioned some as control systems of the final sections and others as control systems of the initial sections of the guides; the screws used are, for example, of the double-headed type, although other types of screws can also be used.

The first transitory phase in which the bar segments are fed alternately one at a time into the initial and final sections of the peripheral guides in sequential order until they are completely filled is followed by a phase operating at full speed in which, for each segment inserted in a section of a guide another previously inserted segment is unloaded from the drum onto the relative wormless screw or onto other suitable transfer means.

With this unloading operation the handling time of the segments on the screws, once unloaded from the drums is lower than the time of known prior art apparatus. In particular, with this worm screw system bar segments of 6 m can be unloaded at a rolling speed of 40 m/s.

Figure 4:
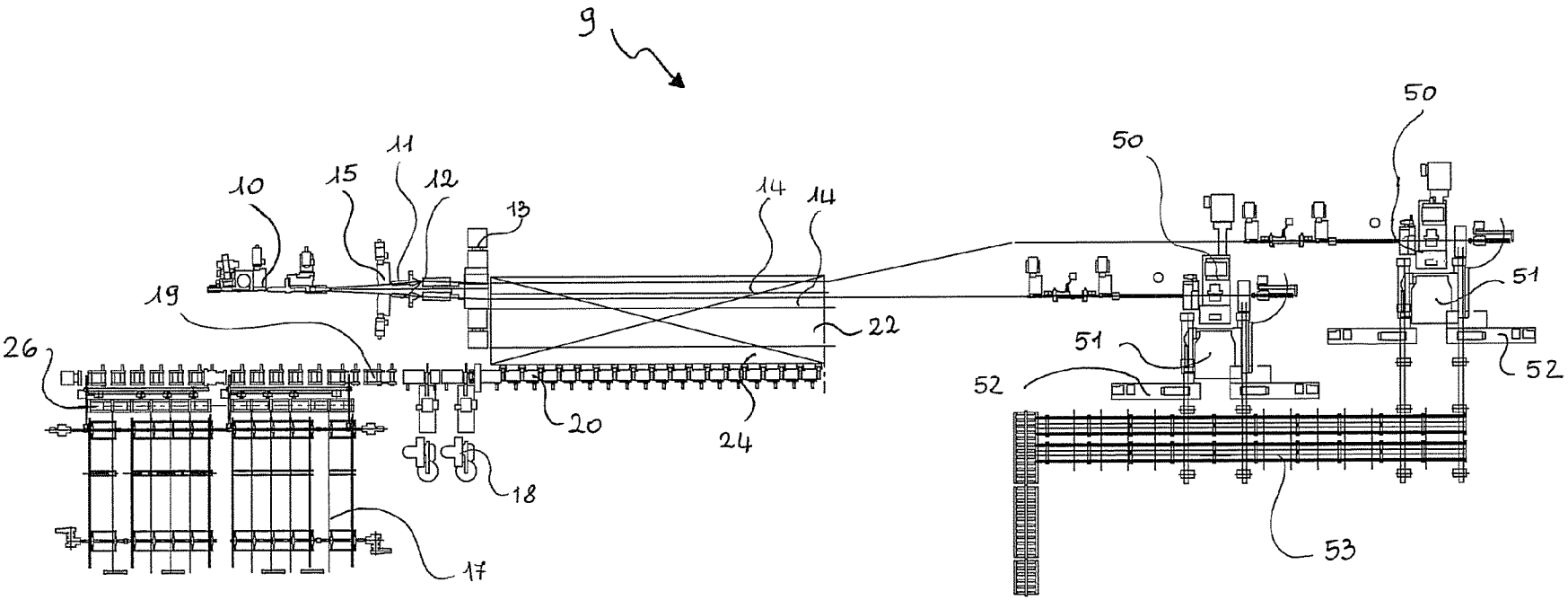
FIG. 4 shows a plan view of a second embodiment of part of the plant of the invention.
Figure 5:
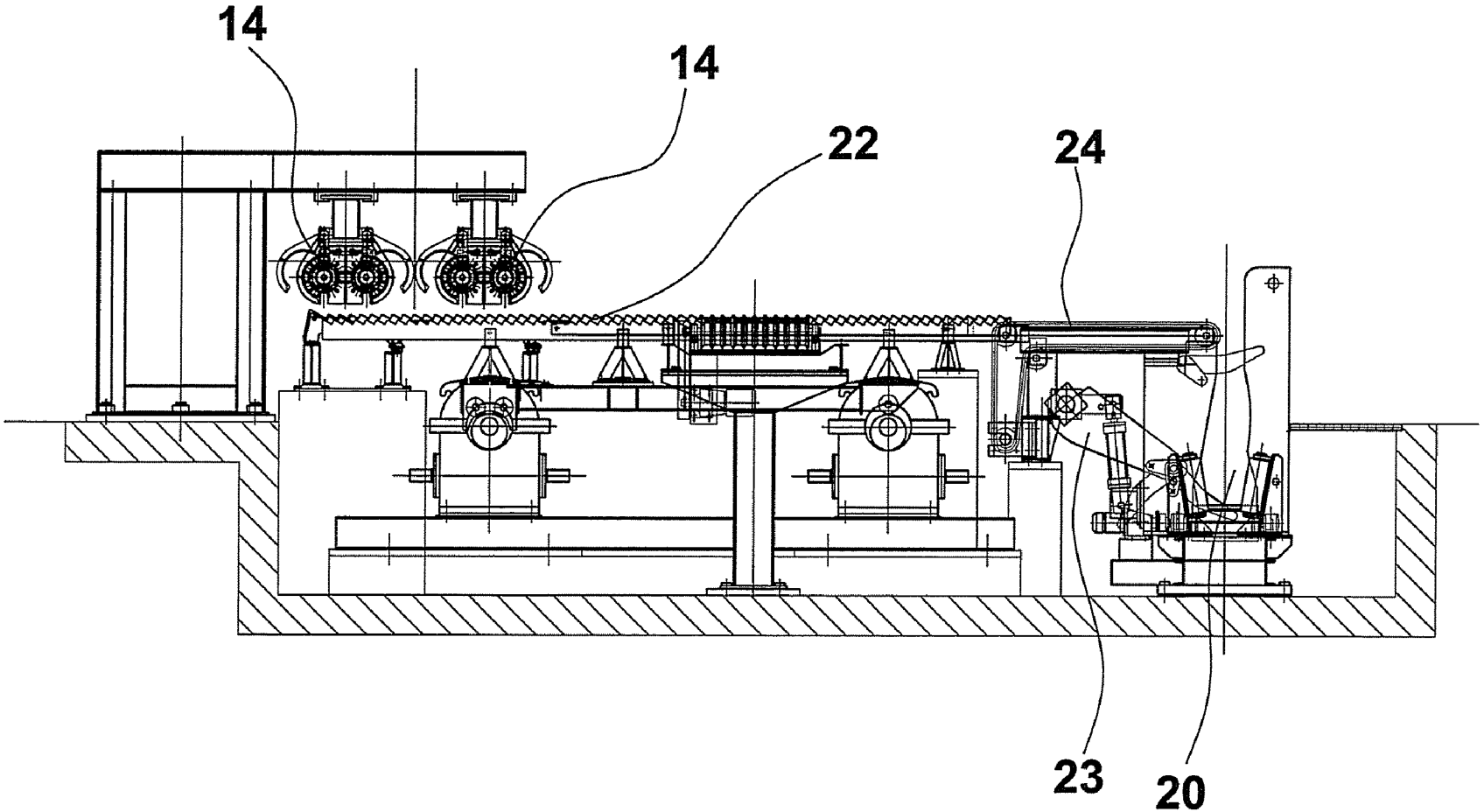
FIG. 5 shows a front view of the second embodiment of part of the plant of the invention.

In accordance with a second embodiment, shown in FIGS. 4 and 5, the collection and removal device incorporates a cooling bed 22, having, for example, a length of 21 meters, with sawtooth shaped fixed blades and moving blades of known type, to lift and translate the bar segments.

The drums 14 and the collection and removal device, in the embodiment of screw or group of worm screw 21 or in the embodiment of the cooling bed 22, cooperate with a station to form and remove bundles of bars comprising: a stepped transfer device for layer preparation 24, a bundle forming device 23 with vertically moving pockets, a collection pocket 20, comprising for example idle vertical containment rollers and a horizontal roller table.

This packaging apparatus can also be provided with:

- pinch rolls 15 on the two lines exiting from the shear 10 for cutting to length;
- tying machines 18 for the bar segments;
- roller tables 19 for transferring the bundles or packs;
- a weighing station 26;
- groups of collection and storage pockets 17 for the bundles or packs.

Advantageously the drums 14 can also cooperate with a station to form and remove skeins, showed in FIG. 4, that comprises two spoolers 50 with horizontal or vertical or inclined axe.

This station to form and remove skeins, placed downstream of the cooling bed 22 in FIG. 4, comprises also a extraction group 51 of skeins for each spooler 50, tying machines 52 and the skeins removal table 53.

The presence of this further station advantageously confers a high flexibility on the same plant: in fact this configuration permits to pass endless and without any stop of the plant from the product "bars in bundles" to the "coiled" or "spooled" product or in coils, and therefore to satisfy all the market demands.

Furthermore, this permits an intermediate solution that provides to discharge a bar in the cooling bed 22 or in the screw 21 and to send another one towards one of the two spoolers 50 by means of the drums 14. An automation system controls the shear 10, the bar-brake 13 and the drums 14 in function of the desired production mix.

In the case of skeins production, the bar delivered from the last rolling stand is cut by the shear 10 into segments of a predefined length dependent from the desired weight of coil. The deflectors 11 and 12 direct the segments into the four unloading lines wherein the bar-brakes 13, installed at the entry to each of the four unloading lines, receive the tip of a bar segment by means of rollers in the open position and rotating at a specific speed. At the exit from the bar-brake, these segments are fed to one of the axial peripheral guides or channels on the cylindrical drums 14, in this case said drums being fixed and not rotating, or fed to the cooling bed 22 or to the screw 21 under the drums 14. At the exit of the drums 14 the segments are then fed to the spoolers 50 of the station to form and remove skeins.

Figure 4A:
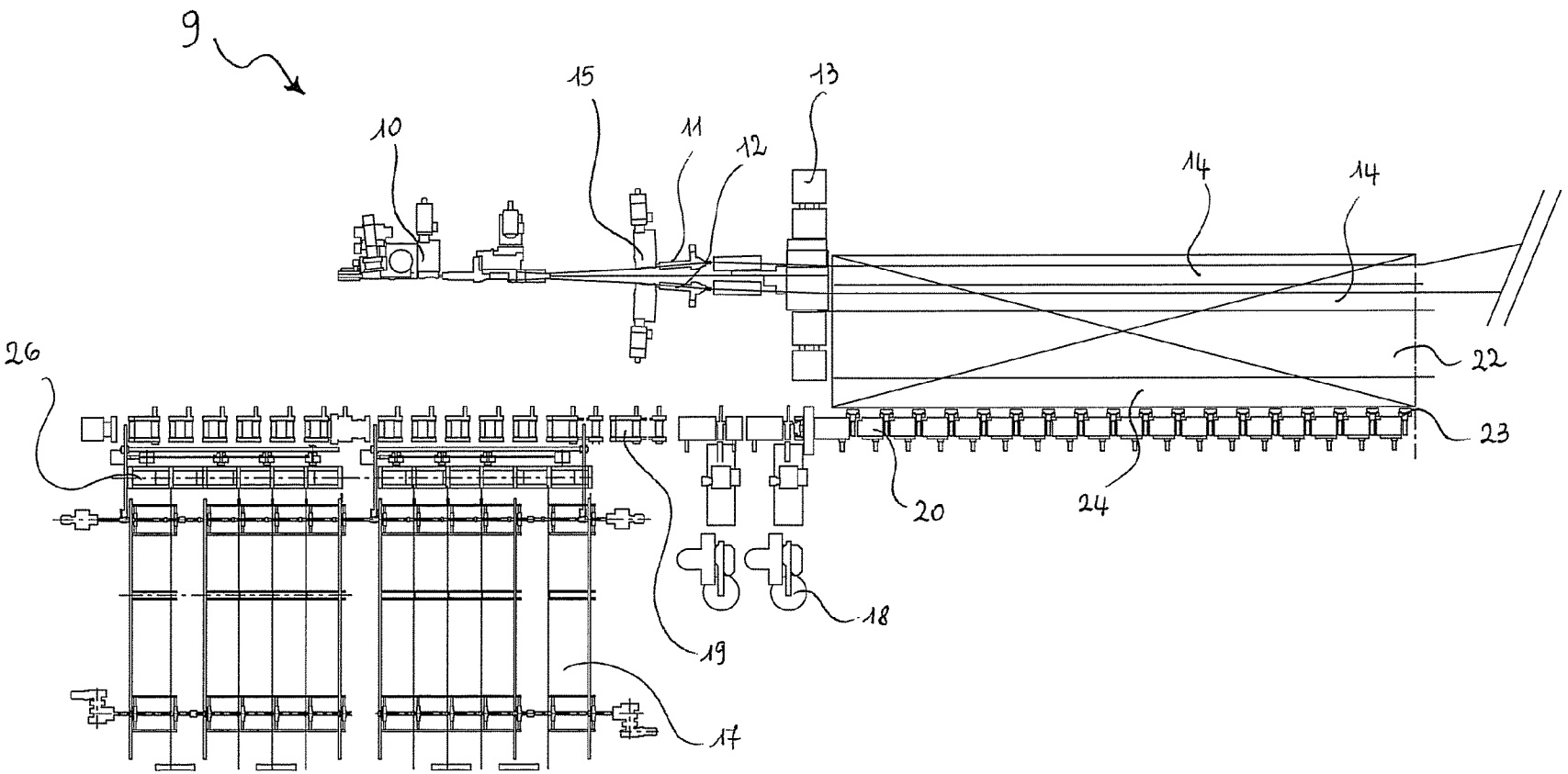
FIG. 4*a* shows a plan view of a part of the second embodiment of FIG. 4.
Figure 6A:
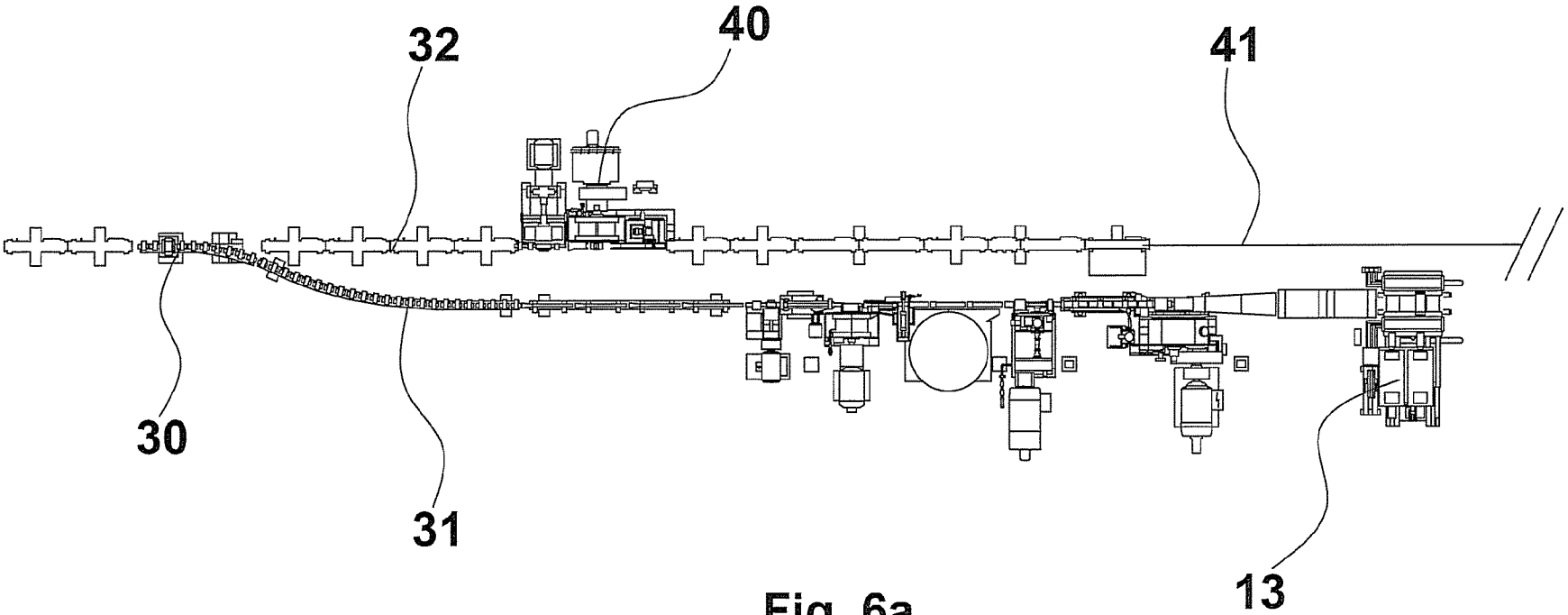
FIGS. 6*a* and 6*b* show a plan view respectively of a first section and of a second section of a third embodiment of part of the plant of the invention.
Figure 6B:
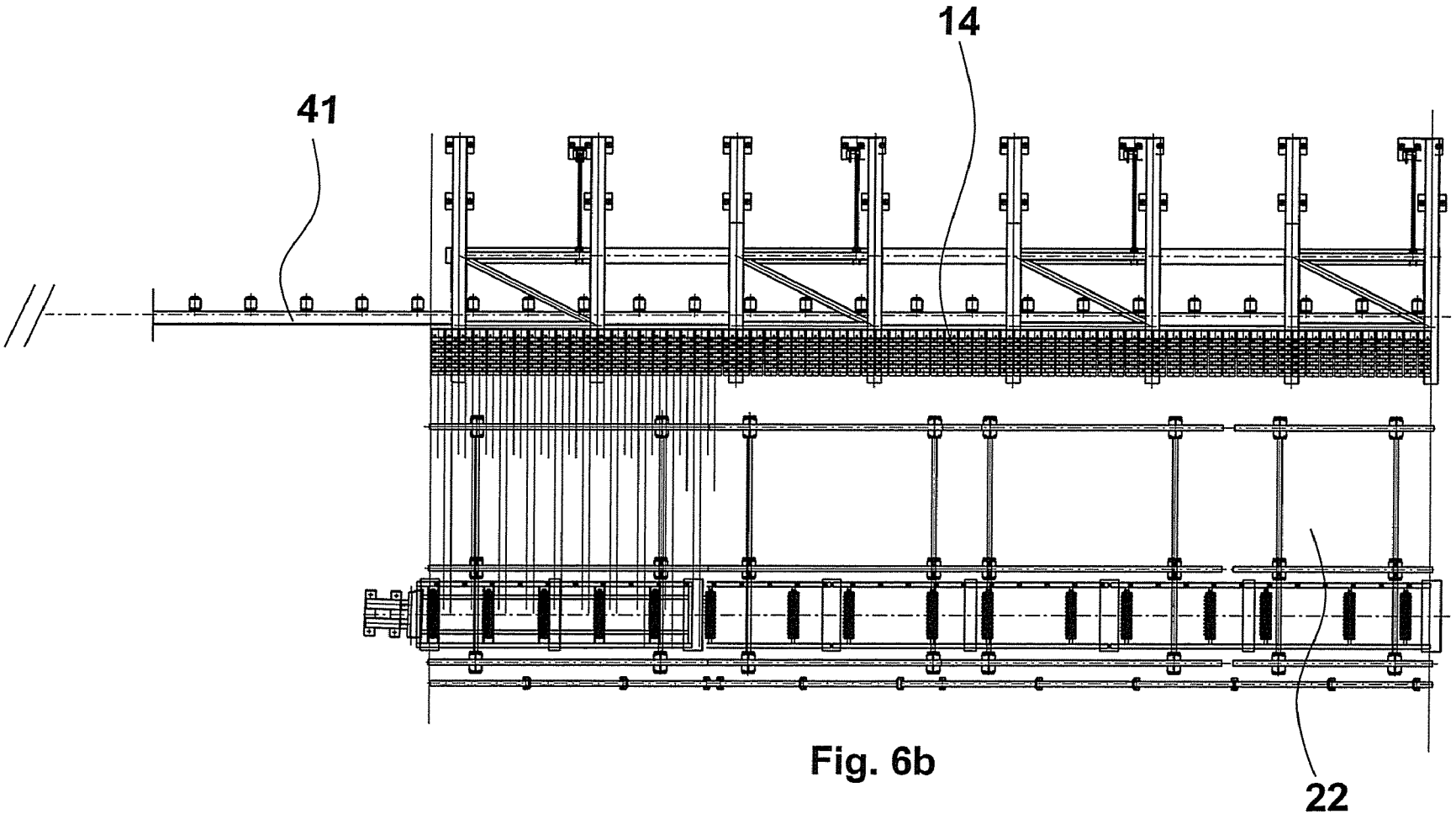
Figure 7:
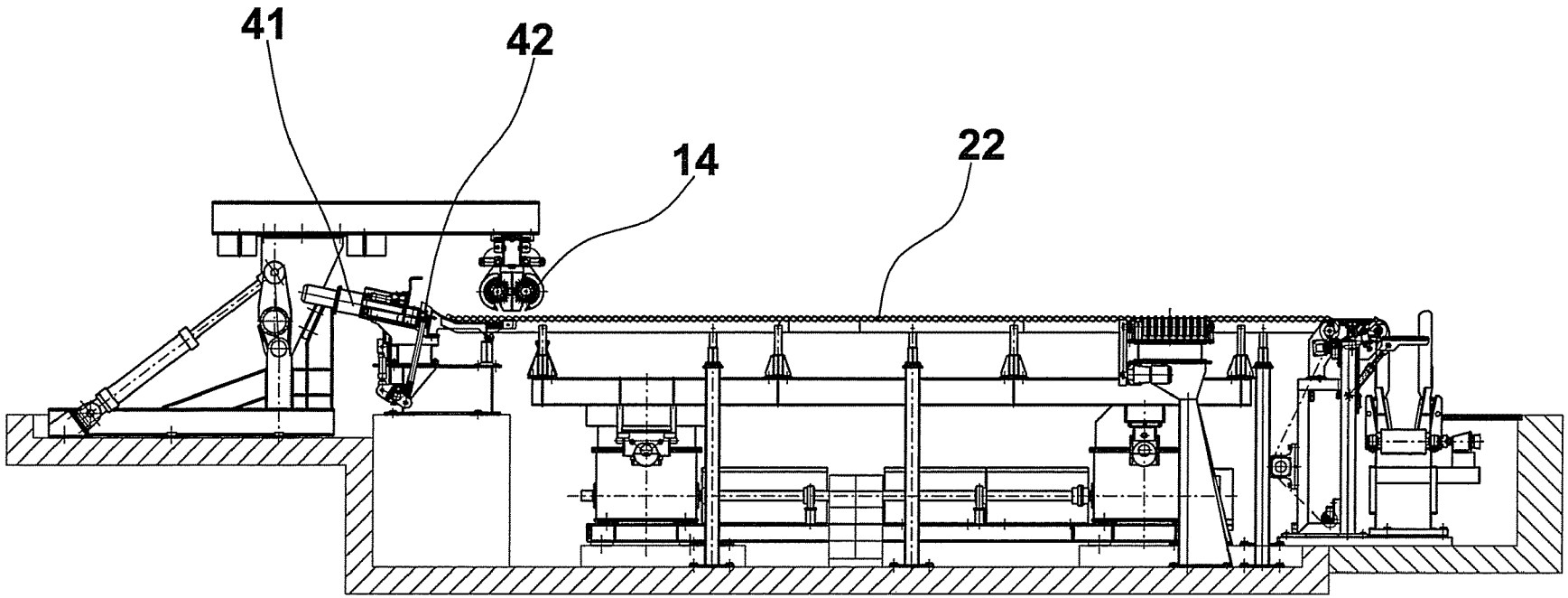
FIG. 7 shows a front view of the third embodiment of part of the plant of the invention.

In accordance with a second embodiment of the invention, shown in FIGS. 6*a*, 6*b* and 7, besides bars or profiles with small sections the plant can also produce bars or profiles with large sections, having, for example, a maximum cross dimension of over 25 mm, or in any case, too large to be received by a guide of the drums 14. In this embodiment, the packaging apparatus 9 incorporates a first high speed packaging line 31 for bars or profiles of small dimension, similar to the one described previously, simply called high speed line, and a second low speed packaging line 32 for bars or profiles of large dimensions, simply called low speed line, which can be activated selectively by means of a switch 30 positioned downstream of the last rolling mill. Said lines 31, 32 run parallel to each other and unload the product on the same cooling bed 22 which cooperates downstream with essentially the same components provided in the embodiment of the bundles collection and removal device in FIG. 5, described above, or with the components of the station to form and remove skeins of FIG. 4*a*.

In this way the same cooling bed is advantageously used without intermediate receiving and translating devices. Moreover, in the event of an emergency or fault in the high speed line 31 it is possible to use the low speed line 32 to unload products with small sections, in this case with reduced productivity.

The high speed line 31 shown in FIGS. 6*a*, 6*b* and 7, has, for example, only two lines or unloading tables, and therefore in this case the number of bar-brakes 13 and rotating drums 14 is halved with respect to the first embodiment.

The low speed line 32 is instead structurally formed by the combination of at least one rotating shear 40, to cut to commercial length the rolled product, still hot, delivered from the last rolling stand, and an inclined roller table 41 with lifting fingers or lifting aprons 42, of known type. These lifting fingers 42 are disposed between the roller table 41 and the cooling bed 22 and move alternately upwards and downwards, to laterally transfer the segments fed from the roller table onto the cooling plate; said lifting fingers 42 have a flat and inclined upper surface in order to slide the segments onto the first or onto the second compartment of the cooling bed 22 according to the lifting stroke thereof.

The operating mode of the low speed line 32 allows removal of the segments of rolled product without interfering with the other rolled elements travelling on the same roller table 41. To obtain this, advantageously the time at which the segment of rolled product, to be removed laterally onto the cooling bed, arrives on the roller table 41 and the time at which the finger 42 is lowered and lifted are coordinated perfectly, so that the previous and subsequent segments are removed separately.

More specifically, a method of unloading the low speed line 32 for bars or profiles, having, for example, a length ranging from 6 to 9 meters, includes the following stages:

- arrival of a first segment of rolled product on the roller table 41, and subsequent feed thereof by said rollers, said rollers being motorized, to a first predetermined position, on said roller table, suitable for unloading onto the cooling bed;
- arrival of a second segment of rolled product, immediately behind the first segment and at a suitable distance therefrom, and subsequent feed thereof by said rollers to a second predetermined position, on said roller table, suitable for unloading onto the cooling bed;
- lowering of a lifting finger 42 and descent through gravity from the roller table 41 of the first and second segments which are positioned on the end of said finger: sliding friction produced with the side of the rolled product lowering cooling bed slows down and stops the segments;
- lifting of the lifting finger 42 to the level of the first and second compartments of the cooling bed 22 and sliding of the segments into said first and second compartments, for each phase of forward movement of the cooling bed, while a third and a fourth segment are already occupying the roller table 41.

At this point the cycle is repeated, with subsequent arrangements of the segments on the cooling bed.

The movement of the moving blades of the cooling bed 22 is correlated to the cross dimension of the segments, i.e. it is of an extent that when this dimension exceeds the dimension of the compartment of the cooling bed, the segments are deposited on the cooling bed alternately, i.e. in every second compartment instead of in every compartment.

The method of unloading bars or profiles of a length ranging from 10 to 18 meters is analogous to the one described above and a single segment is unloaded at a time instead of two segments.

The second embodiment of the invention therefore allows receipt of bars or profiles having a maximum cross dimension in excess of the space allowed by a guide of the drums 14.

The packaging apparatus in the different embodiments described above is capable of producing bars and/or profiles, already cut to commercial length, in packs or bundles or skeins ready for sale. The structural characteristics of the components and the particular arrangement thereof allow noteworthy compacting of the entire plant with respect to known plants and a reduction in initial investments costs, as the devices for bundle-forming, tying and storage are reduced to a minimum and integrated in a single packaging apparatus.

More specifically, with respect to a conventional apparatus:

- the cooling bed 22, in the embodiments in which it is present, has a drastically reduced length, as the bars are already directly cut to commercial length upstream;
- the shears for cutting to length, conventionally positioned downstream of the cooling bed, are eliminated;
- the roller table at the exit from the cooling bed and subsequent layer preparation device are eliminated, being replaced with a single transfer device 24;
- the intermediate bundle-forming area is eliminated;
- the operation and relative machinery for head-tail cropping of the layers, is eliminated.

The advantages deriving from the production of a compact continuous plant according to the present invention are as follows:

- reduced length of the technological line;
- lower initial investment costs due to the compactness of the line, as more compact components occupy a smaller surface area of the sheds resulting in lower incidence on costs for foundations and building works;
- decreased conversion cost and a reduction in energy utilized;
- reduction in operating personnel and therefore lower manpower costs;
- greater flexibility thanks to the possibility of producing a diversified variety of rolled products of all shapes and sizes, i.e. large or small, round, square, flat, with various profiles, etc.

Moreover, with the plant according to the invention it is possible to obtain the finished product, starting from liquid steel, without interruption in the form of directly marketable packs, bundles or skeins with predefined weight, dimensions and/or number of bars and/or profiles.

This plant is particularly advantageous when used for a single strand plant, in particular plants used for the production of commercial quality bar having a circular section, packaged in the form of bundles or skeins. In the case of skeins, the "spooled" product has generally a weight of about 3-3.5 tons.

The plant of the invention has an overall length, from the casting axis to the end of the finishing station, of approximately 130-140 meters. Advantageously, this implies a reduction in the dimensions of the sheds compared to know plants of 30-40% and a cutting in half of the investment costs. With a plant of this type the conversion time from the start of casting to the packaged finished product which can be obtained is of around 4 minutes at the maximum rolling speed.

Another embodiment of the invention provides for an arrangement of the components in line with a curve of 180° upstream of the finishing mill in order to further reduce the overall length of said plant by approximately 50 meters.

The invention claimed is:

1. Compact plant for continuous production of steel bars and/or profiles from liquid steel, incorporating a steel plant station, a continuous casting station (3) suitable to cast billets, a rolling station (6, 7, 8) directly linked to the continuous casting station (3), a finishing station comprising a packaging apparatus suitable to package said bars and/or profiles in packs or bundles of a defined weight, said stations being all in line without intermediate interruption points wherein said packaging apparatus (9) is provided with a first shear (10) at the exit of the last rolling stand of said rolling station (6, 7, 8) for cutting directly at commercial length, at rolling speed, still hot bars and/or profiles of indefinite length delivered from the last rolling stand.

2. Plant as claimed in claim 1, wherein said steel plant station incorporates a scrap yard, a primary furnace to melt scrap and a secondary furnace for secondary metallurgy of liquid steel.

3. Plant as claimed in claim 1, wherein said continuous casting station (3) incorporates a continuous single-line casting machine and a straightening machine placed downstream.

4. Plant as claimed in claim 1, wherein said rolling station incorporates a roughing mill, an intermediate mill and a finishing mill.

5. Plant as claimed in claim 1, wherein there is provided an induction furnace (5) upstream of the rolling station to regulate the temperature of the billet.

6. Plant as claimed in claim 4, wherein a device to control pulling force on the steel bars and/or profiles during rolling is provided in said rolling station.

7. Plant as claimed in claim 1, wherein a bar cooling station is provided between the rolling station (6, 7, 8) and the finishing station (9).

8. Plant as claimed in claim 1, wherein said compact packaging apparatus (9) incorporates a first packaging line (31) comprising:

said first shear for cutting at commercial length (10), for cutting a bar into segments of a predetermined length, while said bars and/or profiles of indefinite length are moving at a first speed along a trajectory parallel to the axis thereof;

deflecting means (11, 12) for the bar segments to feed said bar segments along a plurality of predetermined directions;

speed variation means (13) to vary the speed of the bar segments to a second predefined speed differing from the first speed;

one or more pairs of adjacent cylindrical drums (14), defining respective axes and suitable to rotate about the respective axis, wherein the cylindrical drums are provided with a plurality of guides along the respective peripheries, the guides being essentially parallel to the axis of the respective drum, of a length at least double the length of the bar segments and defining a section proximal to and a section distal from said speed variation means (13), and wherein each of said predetermined directions is parallel to the axis of the respective drum, transfer means, suitable to transfer the bar segments to a further holding station, followed by unloading of said segments from the guides of the cylindrical drums.

9. Plant as claimed in claim 8, wherein each of said transfer means (21) is associated with and acts as control system of one of the proximal and distal sections of the guides.

10. Plant as claimed in claim 8, wherein said transfer means are composed of a cooling means (22) provided with fixed and moving blades.

11. Plant as claimed in claim 10, wherein a second packaging line (32) is provided, arranged parallel to said first packaging line (31), and comprising:

a second shear (40) for cutting to size bars and/or profiles of indefinite length into segments of a predetermined length, while said bars and/or profiles of indefinite length are moving along a trajectory parallel to the axis thereof, an inclined roller table (41), said rollers being motorized and suitable to transport said segments to a predetermined position on said roller table, lifting finger means (42), suitable to laterally remove said segments from said predetermined position through a first downward movement, and to transfer them subsequently onto cooling means (22) through a second upward movement.

12. Plant as claimed in claim 11, wherein said drums (14) cooperate downstream with a station to form and remove bundles of the bar segments or with a station to form and remove skeins.

13. Plant as claimed in claim 8, wherein further cooling means are provided, suitable to act in cooperation with said transfer means.

14. Plant as claimed in claim 8, wherein said drums (14) cooperate downstream with a station to form and remove bundles of the bar segments or with a station to form and remove skeins.

15. Method for continuous production and packaging of bars and/or profiles, by a compact production plant as claimed in one or more of the previous claims, wherein the plant incorporates a steel plant station, a continuous casting station (3), a rolling station (6, 7, 8) directly linked to the continuous casting station (3), a finishing station comprising a packaging apparatus (9), said stations being all in line without intermediate interruption points, the method comprising the following stages:

a) melting scrap to obtain liquid steel and secondary metallurgy operations by meams of the steel plant station, b) casting the liquid steel by casting means in the continuous casting station (3)

c) rolling the billets by means of several stands in the rolling station (6, 7, 8) directly linked to the continuous casting station (3), d) performing packaging operations of the bars and/or profiles by means of the packaging apparatus (9) of a finishing station, wherein said stages from a) to d) take place in succession without any interruption between one stage and the next and wherein the packaging operations comprise a stage of cutting directly at commercial length, at rolling speed, the still hot bars and/or profiles of indefinite length, delivered from the last rolling stand of said rolling station (6, 7, 8) into bar segments, by means of a first shear (10) placed at the exit of the last rolling stand, and forming packs or bundles of a defined weight ready for sale.

16. Method as claimed in claim 15, wherein the packaging operations further comprise the following stages:

f) deflecting the bar segments in order to feed them along a plurality of predetermined directions, g) modifying the speed of the bar segments to respective predefined speeds, h) inserting each bar segment cyclically, through a translatory movement in an axial direction, alternately first in the section distal from the speed variation means (13) of a first guide of a drum (14) and subsequently in the section proximal to the speed variation means (13) of a second guide adjacent to the first, or vice versa, i) unloading each bar segment from a section of a guide onto transfer means, associated with said section, k) transferring the bar segments to a further handling station.

17. Method as claimed in claim 16, wherein the packaging operations comprise the following stages:

f') inserting a first bar segment, through a translatory movement in an axial direction, into a motorized roller table (41), and subsequent movement thereof to a first predetermined position on said roller table (41), g') inserting a second bar segment into the roller table (41), at a suitable distance from said first segment, and subsequent movement thereof to a second predetermined position on said roller table (41), h') laterally removing the first and second segments from said predetermined positions through a first downward movement of lifting finger means (42), i') moving said segments onto cooling means (22) through a second upward movement of said lifting finger means to the level of said cooling means, j') transfer said segments to a further handling station.

18. Method as claimed in claim 17, wherein the stage j') is repeated during each phase of forward movement of said cooling means while a third and fourth segment are already occupying the roller table (41).

19. Method as claimed in claim 15, wherein the rolling stage is a main, or "master", operation while the casting stage is a dependent, or "slave", operation.

20. Method as claimed in claim 15, wherein the stage of cutting directly at commercial length, at rolling speed, the bars and/or profiles delivered from the last rolling stand is carried out at a temperature of between 600 and 900° C.

* * * * *

UNITED STATES PATENT AND TRADEMARK OFFICE

CERTIFICATE OF CORRECTION

PATENT NO. : 8,046,901 B2
APPLICATION NO. : 11/885423
DATED : November 1, 2011
INVENTOR(S) : Giuseppe Bordignon et al.

It is certified that error appears in the above-identified patent and that said Letters Patent is hereby corrected as shown below:

On the Title Page:
Item (73) Assignee: should read, Danieli & C. Officine Meccaniche S.p.A., Buttrio (IT)

Signed and Sealed this
Thirty-first Day of January, 2012

David J. Kappos

David J. Kappos
*Director of the United States Patent and Trademark Office*